US008550817B2

(12) United States Patent
Preston et al.

(10) Patent No.: US 8,550,817 B2
(45) Date of Patent: Oct. 8, 2013

(54) TRAJECTORY SIMULATION SYSTEM UTILIZING DYNAMIC TARGET FEEDBACK THAT PROVIDES TARGET POSITION AND MOVEMENT DATA

(75) Inventors: Steven Preston, Winter Springs, FL (US); Edward S. Kaprocki, Debary, FL (US); Thomas H. Penner, Apopka, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 743 days.

(21) Appl. No.: 12/684,750

(22) Filed: Jan. 8, 2010

(65) Prior Publication Data

US 2011/0311949 A1 Dec. 22, 2011

(51) Int. Cl.
*F41A 33/00* (2006.01)

(52) U.S. Cl.
USPC ..... 434/11; 434/19

(58) Field of Classification Search
USPC ..... 434/11–27; 356/141.1, 141.2, 141.4; 463/2

See application file for complete search history.

(56) References Cited

U.S. PATENT DOCUMENTS

| | | | | |
|---|---|---|---|---|
| 3,104,478 | A * | 9/1963 | Strauss et al. | 434/22 |
| 4,315,689 | A * | 2/1982 | Goda | 356/141.1 |
| 2009/0035730 | A1 * | 2/2009 | Lindero | 434/22 |
| 2010/0297589 | A1 * | 11/2010 | Ruud | 434/21 |

* cited by examiner

*Primary Examiner* — Timothy A Musselman
(74) *Attorney, Agent, or Firm* — Jetter & Associates, P.A.

(57) ABSTRACT

A target in a physical environment can be interrogated. Feedback can be received from the target that is encoded within a radio frequency signal. The feedback can include position and movement data of the target. Adjustments can be calculated for a simulated kinetic projectile traveling to the target. The adjustments can account for target movement, kinetic projectile travel time, and travel path to the target. A distance from a point of origin of the simulated kinetic projectile to the target and movement of the target relative to the point of origin can be determined utilizing the feedback. A result signal can be conveyed that includes result data. The result data can include all information necessary for the target to react to the simulated kinetic projectile.

18 Claims, 6 Drawing Sheets

TRAJECTORY SIMULATION SYSTEM UTILIZING DYNAMIC TARGET FEEDBACK THAT PROVIDES TARGET POSITION AND MOVEMENT DATA

BACKGROUND

The disclosure relates to the field of tactical engagement simulation systems (TES) and, more particularly, to target position augmented trajectory simulation systems that utilize dynamic target feedback.

TES is a training system for using weapons and conducting force-on-force exercises. In a TES simulation, laser transmitters are often used instead of bullets, larger rounds, or shorter-range guided weapons such as anti-tank missiles. These laser transmitters are mounted on the weapon and aligned with the weapon's barrel.

Predecessor laser based TES systems have required use of high power laser rangefinders and/or delicate retro-reflectors to simulate kinetic ordinance behavior. Additionally, at present, most TES systems attempt to determine what actions are to be taken after a trigger pull. A determination delay results, where a shooter must maintain a sight picture with the target (e.g., target must remain in a line-of-sight, and a weapon-to-target relative positioning must remain relatively fixed) until the selection of a target, determination of target range, determination of target velocity, and determination of adjusted aim point are all completed.

This approach is flawed in that it is not representative of a real-world situation. That is, during the simulation exercise, dynamic movement across a simulated physical battlefield environment occurs where a target and a shooter are both moving. Shooter movement can include turret movement as well as shooter vehicle movement in a given direction. The line-of-sight delay for traditional TES systems is an artificial constraint causing an operator of a weapon system to not be permitted to select a new target immediately after firing. Instead, the operator must delay post-firing for a delay period to pass (this delay period is one in which the computations are performed and line-of-sight must be maintained). Besides having to account for target and shooter movements, additional external events, such as an appearance of optical obstructions (for example, smoke and/or powder clouds from weapon simulation effect (WES) components), can impose themselves in a line-of-sight path between a shooter and target during the delay period.

Failure to maintain the sight picture (altering line-of-sight) of the fired weapon during this delay period produces inaccurate simulation results. One possible inaccuracy is that a firing event that should have resulted in a hit will not result in one. Another possible inaccuracy is that compensation mechanisms implemented to compensate for the delay period are overly generous, which result in false positive hits.

BRIEF SUMMARY

The disclosure can be implemented in accordance with numerous aspects described herein. One aspect of the disclosure is for a tactical engagement simulation (TES) method, computer program product, and device. According to the aspect, a target in a physical combat simulation environment can be interrogated. Feedback can be received from the target that is encoded within a radio frequency signal. The feedback can include position and movement data of the target. Adjustments can be calculated for a simulated ordinance from a simulated kinetic weapon of a shooter to the target. The adjustments can account for target movement, simulated ordinance travel time, and travel path from the shooter to the target. A distance from the shooter to the target and movement of the target relative to the shooter can be determined utilizing the feedback. A fire result signal can be conveyed that includes fire result data for a firing event to the target. In the aspect, no actual projectile is physically conveyed from the shooter to the target within the physical combat simulation environment. The fire result data can include all information necessary for the target to react to the firing event.

Another aspect of the present disclosure is for another tactical engagement simulation (TES) method, computer program product, and device. According to the aspect, interrogation data can be received from a shooter in a physical combat simulation environment. Responsive to the interrogation data, position data of the target can be determined. This position data can be obtained from position determination component of the target. The position data can include a target position and a target movement vector. The position data can be digitally encoded in a radio frequency signal that is transmitted to the shooter. Fire result data from the shooter can be sensed. An effect of a firing event can be computed. A simulation state of target equipment can be selective adjusted based on the computed effect. The computed effect can indicate that the target is hit by the simulated ordinance fired by the shooter. If the target is hit, the simulated state of target equipment can be adjusted from an active state to a disabled state or can be adjusted downward to a degraded state of operation.

Another aspect of the present disclosure is for a global position system (GPS) augmented trajectory system (GATS), which is a discrete system able to be mounted on a projectile weapon barrel of a weapon system. The GATS system can include a vertical scanning laser, a directional radio frequency (RF) transceiver, a global position system (GPS) component, and a set of computer program products. The vertical scanning laser can be for emitting Multiple Integrated Laser Engagement System (MILES) compliant optical emissions. The directional radio frequency (RF) transceiver can be for emitting radio frequency signals containing digitally encoded data and for receiving radio frequency signals containing digitally encoded data. The global position system (GPS) component can be for determining a geographic position of the GATS within a physical combat simulation environment. When executed, the computer program products can utilize the vertical scanning laser to continuously scan along an axis of the projectile weapon barrel. The GATS can receive, via the directional radio frequency (RF) transmitter, feedback encoded within RF signals from potential targets which sensed the continuous scans from the vertical scanning laser and provided the feedback in response. The computer program products can perform pre-fire event computations that utilize the feedback for determining potential target positions relative to the GATS. The computer program products, when executed, can adjust an aim point of the vertical scanning laser to a position that a potential target must be at in order to be affected by a fire event. Then the computer program products can cause the vertical scanning laser, which has been adjusted aim point, to fire.

Another aspect of the present disclosure includes a method for implementing a virtual shooter within a physical combat simulation environment. In the method, a simulation manager, a radio frequency transceiver, and a set of potential targets can all be communicatively linked via a network. The potential targets can be present in a physical combat simulation environment and can be within wireless communication range of the radio frequency transceiver. In the method, a potential target in a physical combat simulation environment can be interrogated by having the radio frequency transceiver transmit interrogation data to potential targets. Feedback from at least one of said potential target can be received. The feedback can be digitally encoded within radio frequency signals detected by the radio frequency transceiver. The feedback can include position and movement data of the potential target. The simulation manager can determine a geographic position within the physical combat simulation environment of a virtual shooter. The virtual shooter is not a physical entity present in the physical combat simulation environment but is a virtual artifact created and controlled by the simulation manager that emulates a physical shooter positioned for simulation purposes at the determined geographic position. Adjustments can be calculated for a simulated ordinance from a simulated kinetic weapon of a virtual shooter to the potential target. The adjustments can account for target movement and simulated ordinance travel time and travel path from the virtual shooter to the potential target. A distance from the virtual shooter to the potential target and movement of the potential target relative to the determined geographic position of the virtual shooter can be determined using the feedback. Fire result signal generated by the simulation manager can be transmitted via the radio frequency transceiver to the potential target. The fire result signal can include fire result data for a firing event wherein the fire result data uniquely identifies the potential target. The fire result data can include all information necessary for the potential target to react to the firing event.

Another aspect of the present disclosure includes a tactical engagement simulation (TES) method. The method can receive fire result data from a shooter in a physical combat simulation environment. The fire result data can include an ordinance blast radius and a detonation time for a simulated kinetic weapon of the shooter firing a simulated ordinance. No actual projectile is physically conveyed from the shooter to a target within the physical combat simulation environment. The fire result data can be received before the detonation time. At the detonation time, the target can determine its geographic position within the physical combat simulation environment using a position determination component, which is a hardware component of the target. When the determined geographic position the target is outside the ordinance blast radius at the detonation time, the target can take no action related to the fire result data. When the determined geographic position of the target is inside the ordinance blast radius at the detonation time, the target can compute an effect of being within the blast radius of the simulated ordinance. Then the target can selectively adjust a simulation state of target equipment based on the computed effect.

DETAILED DESCRIPTION

Figure 1:
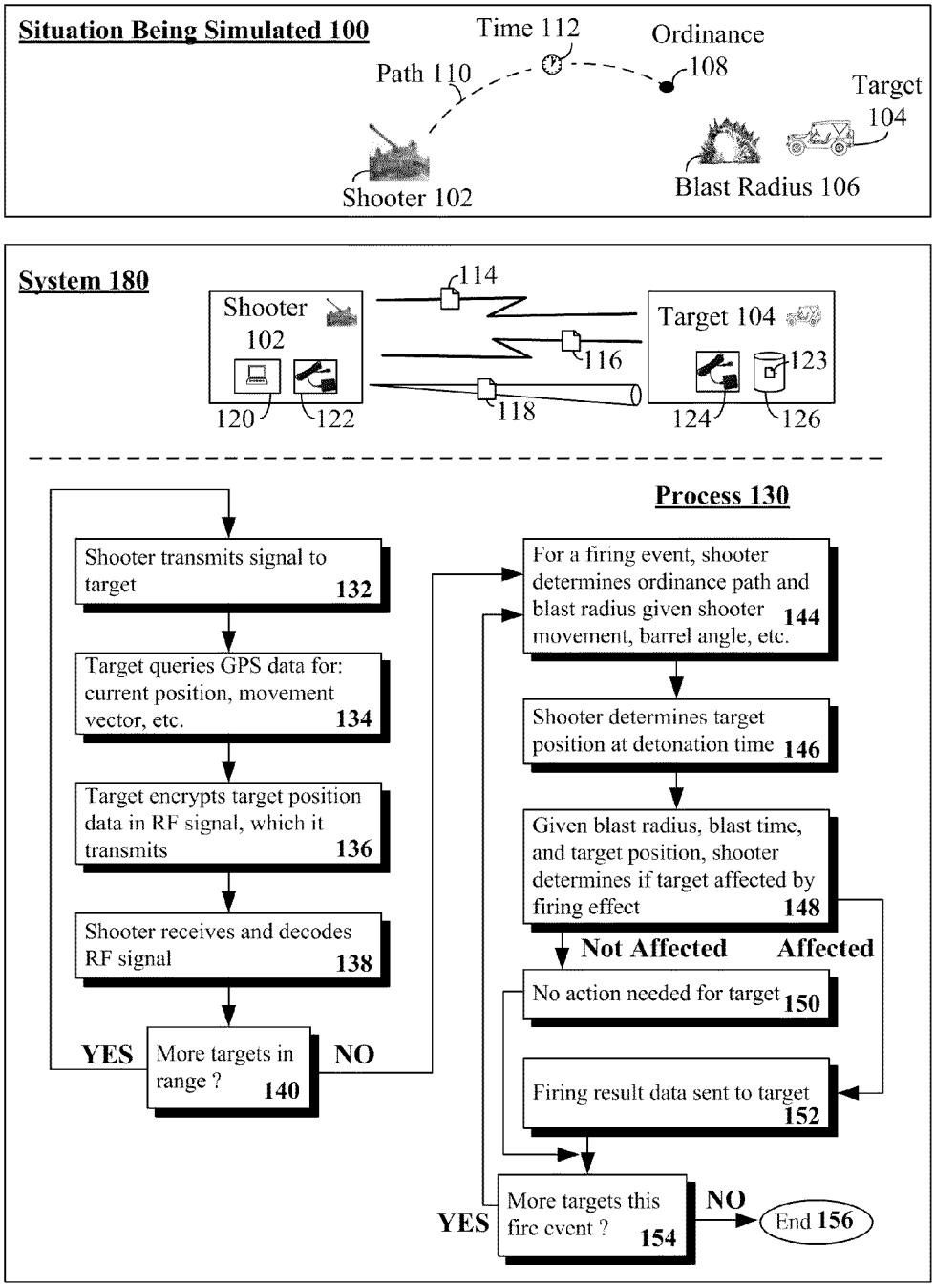
FIG. 1 shows a diagram for a trajectory simulation system that utilizes feedback from a target to adjust for ordinance delay and vehicle movements in accordance with an embodiment of the inventive arrangements disclosed herein.

The disclosure describes a tactical engagement system (TES) that simulates a trajectory of a long distance round without optical feedback from a target (e.g., no retro reflectors used) and without using a laser rangefinder. Instead, the target provides feedback to a shooter, where the feedback is encoded in an RF signal and includes global positioning system (GPS) data from the target's GPS.

In one embodiment of the system, a shooter can define a spatial window (via a laser scanned region, for example). A target can detect that it is within the spatial window and can responsively provide the shooter with target-specific feedback (e.g., GPS position, velocity vector, received vertical scan number, etc.). The shooter, using this feedback, can perform calculations to adjust for shooter movement, target movement, ordinance travel time, and ordinance path. When a fire event occurs, the shooter performed calculations can be used to determine whether ordinance hits or misses the target.

In one embodiment, all critical calculations and laser movements can occur prior to a trigger pull. That is, the calculations can be performed proactively, before a firing event. This allows for an immediate transfer to a different target, after trigger pull, which is required in most gunnery training, yet which is not possible using conventional simulation systems. In another embodiment, a portion of the calculations can occur after a trigger pull, but calculation results can be transmitted to a target via RF signals, which do not require a line-of-sight relationship. Thus, a shooter is still able to immediately reposition a weapon barrel, once an operator has pulled a trigger.

The disclosure provides all necessary functions to allow a shooter to simulate a kinetic weapon discharge, which includes compensation for ordinance travel time, projectile trajectory characteristics, and dynamic target/source movements. In one embodiment, innovations detailed herein can be implemented in existing force-on-force systems without requiring significant hardware modification. Note, implementation of the disclosure may require an addition of a GPS or other position determination component in the target and/or shooter—if one is otherwise lacking.

The disclosure may be embodied as a method, system, or computer program product. Accordingly, the disclosure may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, the disclosure may take the form of a computer program product on a computer-usable storage medium having computer-usable program code embodied in the medium. In a preferred embodiment, the disclosure is implemented in software which includes, but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, or transport the program for use by or in connection with the instruction execution system, apparatus, or device. Any suitable computer-usable or computer-readable medium may be utilized. The computer-usable or computer-readable medium may be, for example but not limited to, an electronic, magnetic, optical, electromagnetic, infrared, or semiconductor system, apparatus, or device. Examples of a computer-readable medium include a semiconductor or solid state memory, magnetic tape, a removable computer diskette, a random access memory (RAM), a read-only memory (ROM), an erasable programmable read-only memory (EPROM) or Flash memory, a rigid magnetic disk and an optical disk. Current examples of optical disks include compact disk-read only memory (CD-ROM), compact disk-read/write (CD-R/W) and DVD.

Computer program code for carrying out operations of the disclosure may be written in an object-oriented programming language such as JAVA, Smalltalk, C++, or the like. However, the computer program code for carrying out operations of the disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN), a wide area network (WAN), or the connection may be made to an external computer (for example, through the Internet using an Internet Service Provider).

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including, but not limited to, keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The disclosure is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

FIG. 1 shows a diagram for a trajectory simulation system 180 that utilizes feedback (116) from a target 104 to adjust for ordinance delay and vehicle movements in accordance with an embodiment of the inventive arrangements disclosed herein. Movement of both the target 104 and the shooter 102 can be tracked and adjusted for, as can ordinance 108 travel time 112, ordinance path 110, barrel angle, and the like. Travel time can be computed from a target position, determined from the feedback (116).

The trajectory simulation system 180 simulates a real-world situation 100 of a shooter 102 firing an ordinance 108 at a target 104. Over a period, which is the ordinance travel time 112, the ordinance 108 follows a trajectory path 110 to a point of detonation (e.g., ground zero), which produces a detonation having a blast radius 106. The target 104 is damaged if it is positioned within the blast radius 106 at the time of detonation, and is otherwise largely unaffected.

As mentioned in the background, it can be challenging to simulate a situation 100 using force-on-force simulation devices, which utilize optical signalizing, such as laser signaling of Multiple Integrated Laser Engagement System (MILES) compliant devices. The challenge is that an optical signal travels from shooter 102 to target 104 along a relatively straight path at a speed of light (i.e., no appreciable delay time exists from when an optical signal is emitted from the shooter 102 to when the target 104 receives/detects the optical signal). Further, calculations for the simulated travel path 110 require a distance between the shooter 102 and target 104 to be known Inherently, the target 104 sensing the optical signal is unable to discern its distance from the shooter 102 from the optical signal. Further, the shooter 102 is unable to determine the distance to the target 104 without reliance on an optical range finder.

Calculations and signaling have historically been initiated by a firing event, which results in a requirement (when bidirectional optical signaling is used) to maintain a fixed weapon position relative to a target 104 position after a trigger pull occurs (e.g., post firing event). Thus, the simulation technology based on optical signals as conventionally implemented for TES/MILES compliant devices is at odds with real-world behavior and real-world training requirements (e.g., rapidly repositioning an aim point of a weapon barrel upon ordinance discharge).

Process 130 shows a method for using feedback (116) from a target 104 to make adjustments to system 180 to accurately reflect situation 100. In step 132, a shooter 102 can transmit an interrogation signal, which includes digitally encoded interrogation data 114, to the target 104. Upon receiving the signal, the target 104 can query a data store 126 of recent global position system (GPS) 124 data 123, as shown by step 134. The GPS data 123 (or data derived from processing the GPS data 123) can include a current position of the target 104, a movement vector of the target 104, and the like. In step 136, the target 104 can encrypt target-specific data 116, such as GPS data 123, in a radio frequency (RF) signal, which it transmits to the shooter 102.

In step 138, the shooter 102 can decode the target provided data 116 from the received RF signal. In one embodiment, different targets 104 can be constantly entering an effective range of the shooter 102, which is capable of concurrently tracking multiple targets 104. Thus, when more than one target 104 are in range of the shooter 102, the process 130 can proceed from step 140 to step 132, where additional target(s) 104 can be interrogated.

Once target-provided data 116 is received, the shooter 102 can compute an ordinance path, blast radius, barrel angle, and can compensate for shooter movement, as shown by step 144. The shooter 102 movement compensations can be based on GPS 122 data maintained by the shooter 102. Processing operations can be performed by a computing device 120, which includes a processor, memory, and one or more computer program products stored in the memory and executable by the processor. This computing device 120 can be disposed in the shooter 102 (as shown) or can be remotely located, yet communicatively linked to the shooter 180.

In step 146, the shooter 102 can determine a target position 104 at ordinance detonation time from the target provided data 116. Then, given blast radius, detonation time, and target 104 position at detonation time, the shooter 102 can determine if the target 104 is affected by a firing event, as shown by step 148. If the target 104 is not affected, the method can progress to step 150, where no additional actions need to be taken. If the target 104 is affected, the method can progress to step 152, where a fire result signal comprising result data 118 can be conveyed to the target 104. The target 104 can suitably react to the result data 118. For example, the target 104 can be "killed" or "wounded", which causes target 104 systems to be selectively disabled or degraded. Multiple targets can be affected by a firing event, which is why the process can optionally progress from step 154 to step 144. Process 130 can end in step 156.

Regardless of a specific manner in which process 130 is implemented, process 130 leverages feedback data 116 from a target 104, where the feedback 116 includes GPS data 123 (or data derived from GPS data 123). The shooter 102 performs processing calculations based on the feedback data 116 to determine whether a target 104 is affected by a shooter's firing event. The process 130 does not require the target 104 to provide optical feedback or to use retro-reflectors. The process 130 also does not require the shooter 102 to use an optical rangefinder and does not require the shooter 102 to maintain a line-of-sight lock on the target 104 for a significant period of time. Thus, barrel movement of a shooter's 102 weapon is not restricted once a trigger pull occurs. No conventional TES system is believed to use dynamic target 104 feedback and/or shooter 102 interpretations, as taught by process 130. Further, conventional TES systems do not generally reverse a trajectory aim point to simulate a trajectory correction, as taught by process 130.

Process 130 can be implemented in various contemplated ways within different TES system configurations. For example, the process 130 can be utilized in a system (an embodiment of system 180) that performs a majority of the movement compensation calculations before a trigger pull (e.g., a firing event 205), which is shown by timeline 210. In another embodiment represented by timeline 220, compensation calculations can be performed responsive to a trigger pull (e.g., firing event 205). Regardless of whether an implementation conforms to timeline 210, timeline 220, or an alternative timeline (e.g., firing event 205 occurs at a different processing point), a number of phases 230-238 will exist. These phases 230-323 can include an initiation phase 230, a target detection phase 232, a target response phase 234, a shooter process phase 236, and a fire reactive phase 238.

Figure 2A:
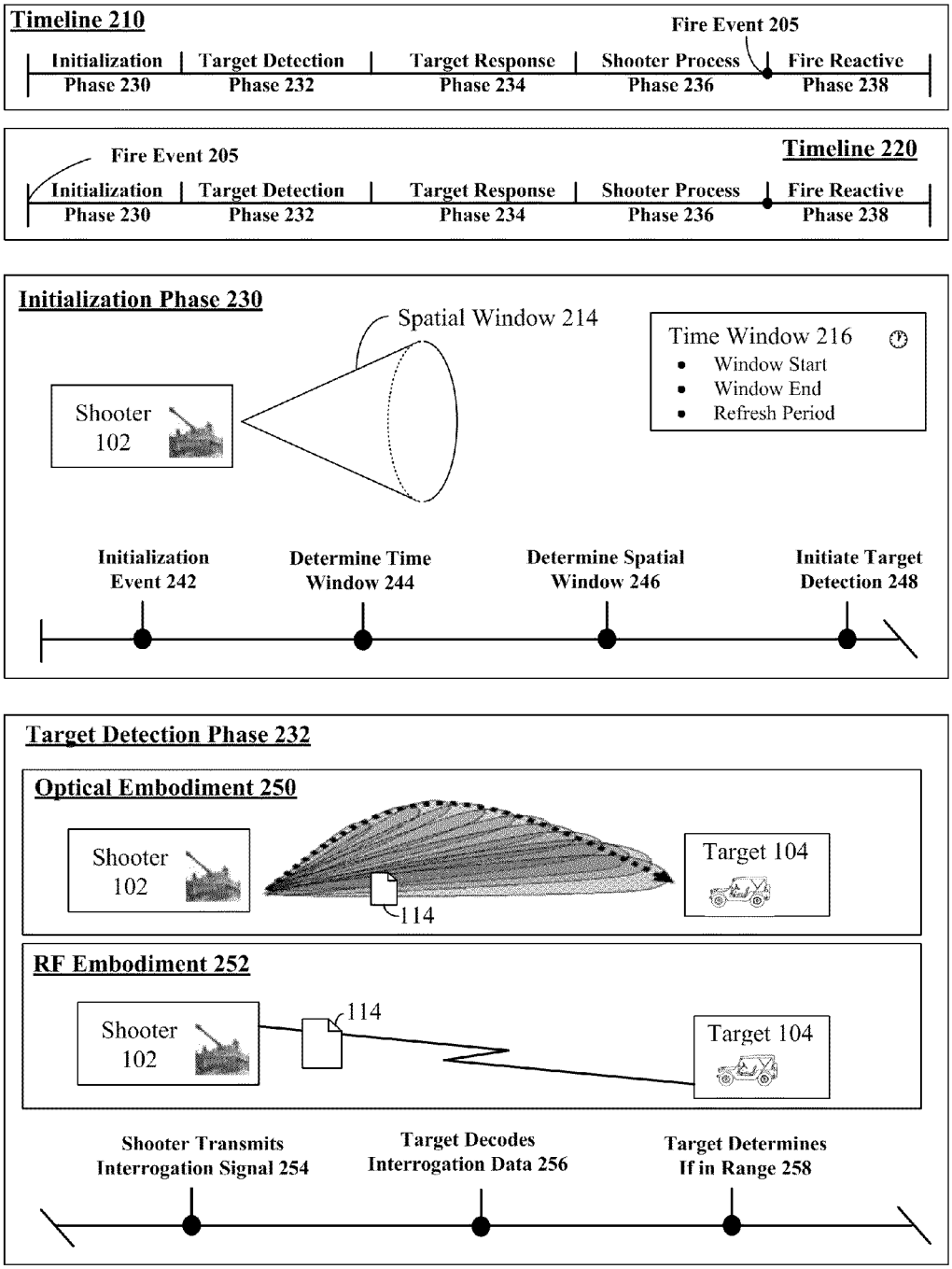
FIGS. 2A and 2B show different phases for utilizing feedback from a target to simulate a kinetic ordinance and to compensate for shooter and target movements in accordance with an embodiment of the inventive arrangements disclosed herein.
Figure 2B:
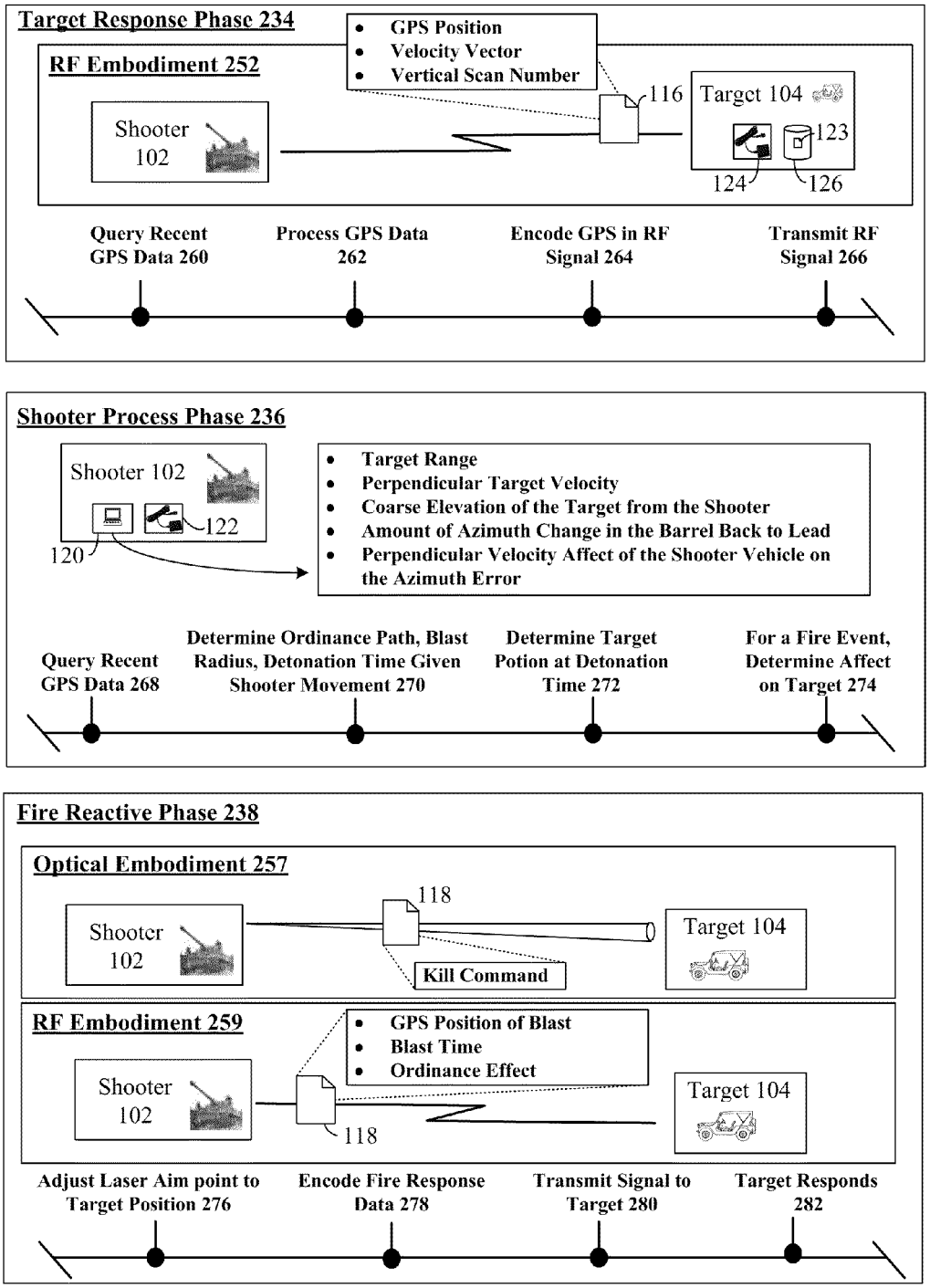

Additionally, regardless of which timeline 210, 220 an embodiment of system 180 uses, a system 180 implementer can make choices relating to shooter-to-target communications. For example, system 180 can be configured so that a shooter 102 communicates with the target 104 via optical signals, RF signals, or combinations thereof. Different embodiments 250, 252 and 257, 259, shown in phases 232, 238 of FIG. 2A and FIG. 2B express the configuration choices present for shooter-to-target communications.

Turning to the initiation phase 230, a series of actions 242-248 can be performed to initiate the system 180. These actions 242-248 can vary from embodiment-to-embodiment. One action can be to detect an initialization event 242. This event 242 can be triggered by turning-on or activating of force-on-force equipment. An optional time window 216 can be determined 244. The time window can, for example, establish a start time and an end time, which can be start and end times for a simulation exercise. A refresh period (for detecting a target 104 in range of the shooter 102, for example) can also be established. The parameters of the time window 216 can be user and/or administrator configurable. In one embodiment, a spatial window 214 can be determined in phase 230. The spatial window 214 can be a geographic region (two-dimensional or three-dimensional) denoting whether a target 104 is in range of the shooter 102. The spatial window 214 can be relatively fixed (centered at the shooter's position) or can dynamically adjust depending on weapon barrel angle, shooter 102 movement, and other such factors. Once the parameters of phase 230 are established, target detection activities 248 can be initiated.

Target 104 detection can result from the shooter 102 transmitting 254 an interrogation request 114 to a target, as shown in phase 232. In embodiment 250, the interrogation request 114 can be implemented by a shooter 102 firing optical signals from a scanning laser, which optical sensors of the target 104 can detect. In embodiment 252, the interrogation request 114 can be conveyed within a radio frequency (RF) signal, which is transmitted from the shooter 102 to the target 104. The RF signal can be directionally focused, or not, depending on implementation choices. In still another embodiment (not shown) a transmitting device remote (a WIFI hub, for example) from the shooter 102 can transmit the interrogation request 114, which the target 104 receives. The target 104 can decode 256 the interrogation data, which results in the target 104 performing programmatic actions in response. During these actions, the target 104 can determine if it is in range of the shooter 102. This can be assumed in some embodiments (such as embodiment 250), but may require processing in other embodiments. For example, coordinates of the spatial window 214 can be conveyed in the interrogation request 114 in embodiment 252, where a target 104 determines from its GPS position whether or not it is located in the defined spatial window 214.

In target response phase 234, the target 104 can query recently obtained GPS data 260. For example, a target's GPS component 124 can record a recent history 123 in a memory 126. This GPS data 123 can be optionally processed 262 by the target and encoded 264 in a radio frequency signal, which the target transmits 266. The encoded data 116 can include, for example, a GPS position of the target 104, a velocity vector of the target 104, a vertical scan number (of a sensed optical signal—assuming embodiment 250), and other such data.

In the shooter process phase 236, the shooter 102 can receive and decode the response 116. The shooter 102 can also query 268 its own GPS component 122. From the shooter's GPS data, shooter 102 movement can be determined. Ordinance path, blast radius, detonation time (given shooter 102 movement) and the like can be determined 270 for a firing event. Further, a target position at detonation time 272 can be determined (from the target's GPS data and velocity vector), which can be used to determine 274 if a fire event of the shooter 102 has an effect on the target 104. Any number of different shooter 102 processes or calculations can be performed by computing device 120 at this phase 254. Calculations can include, for example, target range calculations, perpendicular target velocity calculations, calculations for coarse elevation of the target 104 from the shooter 102, calculations for an amount of azimuth change in the barrel back to the lead, calculations for perpendicular velocity affect of the shooter 102 on the azimuth error, and the like.

In the fire reactive phase 238, the shooter 102 can convey fire response data 118 to the target 104. In one embodiment 257, the shooter 102 can use a laser to convey a kill command to the target 104. This can require an adjustment 276 in a laser aim point to the target position. The adjustment 276 can be based on shooter 102 calculations that utilize target 104 provided GPS data (from feedback 116). For example, target 104 distance can be determined from the feedback (116) provided data, current target position for laser aim point adjustment can be based on target vehicle vector (movement) calculations, etc.

In one embodiment, adjustments to the laser aim point 276 can occur in advance of (and/or independent of) a fire event. These laser aim point adjustments can also occur independent of weapon barrel movement.

In embodiment 259, fire response data 118 can be encoded and conveyed from the shooter 102 to the target 104 over a RF transmission. The response data 118 can optionally include a GPS position of the blast, a blast time, an ordinance effect, and other such data, which can be further processed by target 104. Regardless of whether optical (embodiment 257), RF (embodiment 259), or a combination of signaling is used, the signal(s) can be transmitted 280 to the target 104. The target 104 can respond 282 appropriately to the receipt of the transmission. For example, when the target 104 is hit by the simulated ordinance firing, the target 104 can disable itself (or can degrade its functionality if the weapon strike is insufficient to disable the target 104 completely).

As used herein, a shooter 102 can be a physical entity able to participate in a physical combat simulation environment. The shooter 102 can fire a simulated kinetic projectile weapon that fires a simulated kinetic ordinance having a simulated ordinance trajectory path and simulated ordinance travel time. The shooter 102 does not necessarily generate an actual physical kinetic ordinance discharge that physically travels in the physical combat simulation environment from the shooter 102 to the target 104. The shooter 102 can include a force-on-force device, such as a MILES compliant device. The shooter 102 can be any of a variety of motor vehicles, such as a tank, a HUMVEE, a plane, a ship, and other military (or civilian) vehicles. A shooter 102 can also include a drone, a robot, or other automated payload delivery apparatus. Further, shooter 102 can include a human operated ordinance delivering weapon, such as a rocket launcher, a mine launcher, a grenade launcher, a catapult, a ballista, a trebuchet, a cannon, and firearm, and the like. Basically, the shooter 210 can be any vehicle, weapon, object, or entity capable of delivering a kinetic ordinance, which is able to be simulated in a physical combat simulation environment.

A target 104 can be a physical entity able to participate in a physical combat simulation environment, which is capable of being struck (disabled, degraded, wounded, killed, etc.) by the shooter's simulated ordinance fired from a simulated kinetic weapon. In one embodiment, the target 104 can be capable of moving in the physical combat simulation environment and can include a GPS or other position detection device, which tracks the target's position (relative or absolute) within the physical combat simulation environment. The target 104 can include a motorized vehicle, such as a car, motorcycle, tank, plane, ship, a train, etc. The target 104 can also include a movable item, such as a cart, a raft, a balloon, etc. Target 104 can also be a human being, an animal, a drone, a robot, and the like.

An optical signal (signal from shooter in embodiment 250 or 257, for example) can be an optical signal fired from a shooter 102 and able to be sensed by a target 104. In one embodiment, the optical signal will be generated by a laser and will be in the near infrared spectrum. In various embodiments, the optical signal 172 can have an electromagnetic wavelength above the 400 nm and below 3000 nm, which is an expansive EM range (over traditional definitions of optical signals). In many embodiments, it can be advantageous for the signals 172 to be non-visible to the human eye, which means the wavelength will be above approximately 700 nm. In other embodiments, it can be advantageous for signal 172 to be MILES compliant, which means the wavelength will be approximately (+ or −50 nm) 904 nm. Wavelengths approximately (+ or −50 nm) at 1500 nm can be advantageous as they are known to be safe to an unshielded human eye.

An RF signal (signal from shooter 102 in embodiment 252, 259, or a signal from the target 104 to the shooter 104) can be a data carrying signals falling within the radio frequency spectrum. In various embodiments, any of a variety of RF bands can be used, which include extremely low frequency (ELF) (e.g., wavelength of 100,000 km−10,000 km), super low frequency (SLF) (e.g., wavelength of 10,000 km−1000 km), ultra low frequency (ULF) (e.g., wavelength of 1000 km−100 km), very low frequency (VLF) (e.g., wavelength of 100 km−10 km), low frequency (LF) (e.g., wavelength of 10 km−1 km), medium frequency (MF) (e.g., wavelength of 1 km−100 m), high frequency (HF) (e.g., wavelength of 100 m−10 m), very high frequency (VHF) (e.g., wavelength of 10 m−1 m), ultra high frequency (UHF) (e.g., wavelength of 1 m−100 mm); super high frequency (SHF) (e.g., wavelength of 100 mm−10 mm); extremely high frequency (EHF) (e.g., wavelength of 10 mm−1 mm), and terahertz frequency (e.g., wavelength of 1 mm−90 um) can be used. It can be advantageous, in some embodiments, to constrain RF transmissions to the ultra high frequency range, as that range is standard for mobile phone, wireless LAN, BLUETOOTH, two-way radio, GPS, and other standard communication protocols. In various embodiments, the RF signals and information carried therein will be explicitly formed to conform to a standardized communication protocol, such as one of the IEEE 802.11 based family of standards, BLUETOOTH, ZIGBEE, WIRELESS USB, etc.

Variations are expected and to be considered within scope of the concepts expressed herein. Components of the shooter 102 and target 104 can conform to a variety of standards, such as MILES standards, One Tactical Engagements Simulation System (OneTESS) standards, and the like. For instance, shooter 102 can be a OneMILES Shoulder Launched Munitions (SLM) device, a MILES Combat Vehicle Simulation (CVS) equipment compliant vehicle, and the like. For simplicity of expression, processing operations are shown as being conducted within a computing device disposed in shooter 102 or target 104. Further, signals containing data 114-118 are shown as having originated from shooter 102 or target 104. In a TES system, however, multiple computing components exist, which are communicatively linked to shooter 102 and/or target 104. Processing and/or signal origination can occur within any of these components.

For instance, many TES systems include a simulation manager (e.g., manager 510) that centrally manages simulation activities. These activities can be controlled via a user interface by an authorized administrator. Through this user interface, a user can view images of a physical combat simulation environment. Further, a user of the user interface can be permitted to control one or more aspects of the environment.

Computing components of the shooter 102, target 104, simulation manager, and the like can be communicatively linked to each other via a network. Further, each of these computing components can (optionally) include and/or can access data from one or more data stores, such as data store 126.

The network linking the components can include any hardware, software and firmware necessary to convey data encoded within carrier waves. Data can be contained within analog or digital signals and conveyed though data or voice channels. The network can include local components and data pathways necessary for communications to be exchanged among computing device components and between integrated device components and peripheral devices. The network can also include network equipment, such as routers, data lines, hubs, and intermediary servers which together form a data network such as the Internet. A communication protocol used within the network can conform to an open standard, such as a transmission control protocol/internet protocol (TCP/IP) standard, a MILES standard, and the like. Communication protocols used by the network can also conform to a private or proprietary standard. The network can also include circuit-based communication components and mobile communication components, such as telephony switches, modems, cellular communication towers, and the like. The network can include line based and/or wireless communication pathways.

Each of the data stores (e.g., 126) can be a physical (e.g., volatile or non-volatile memory) or virtual storage space configured to store digital information. The data stores can be storage mediums physically implemented within any type of hardware including, but not limited to, a magnetic disk, an optical disk, a semiconductor memory, a digitally encoded plastic memory, a holographic memory, or any other recording medium. The data stores can be stand-alone storage units as well as storage units formed from a set of physical devices. Additionally, information can be stored within the data stores in a variety of manners. For example, information can be stored within a database structure or can be stored within one or more files of a file storage system, where each file may or may not be indexed for information searching purposes. Further, the data stores can utilize one or more encryption mechanisms to protect stored information from unauthorized access.

Figure 3:
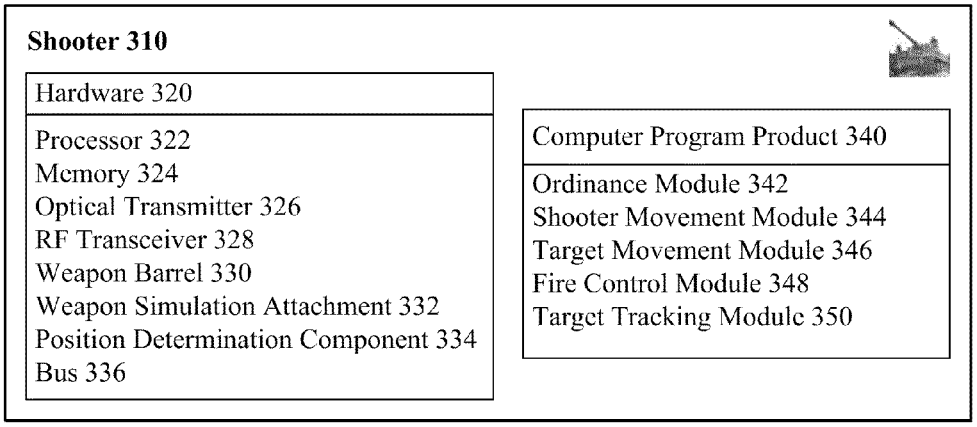
FIG. 3 is a schematic diagram of a shooter in accordance with an embodiment of the inventive arrangements disclosed herein.
Figure 4:
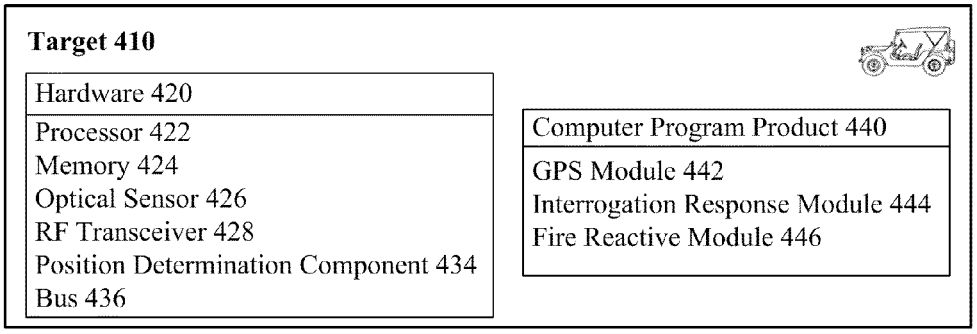
FIG. 4 is a schematic diagram of a target in accordance with an embodiment of the inventive arrangements disclosed herein.
Figure 5:
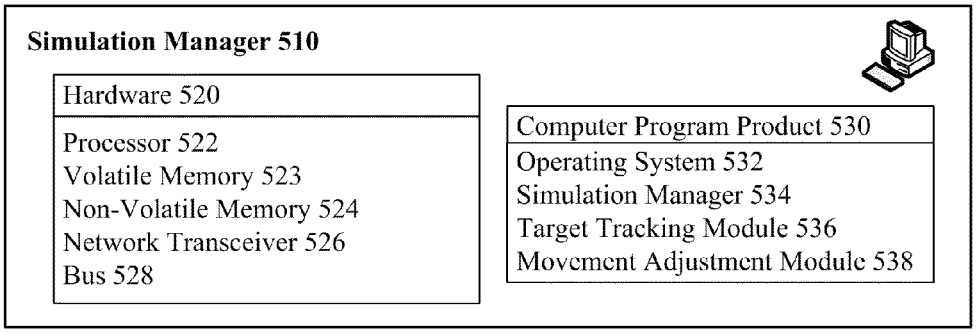
FIG. 5 is a schematic diagram of a simulation manager in accordance with an embodiment of the inventive arrangements disclosed herein.

FIGS. 3-5 show sample configurations, which are not to be construed as limiting, for a shooter 310, target 410, and simulation manager 510. The shooter 310 represents an embodiment of shooter 102; target 410 is an embodiment of target 104; and simulation manager 510 is an embodiment for a simulation control system linked to shooter 102 and/or target 104. The shooter 310 and/or target 410 can include or carry a force-on-force device. In one embodiment, the force-on-force device can be a MILES compliant device.

Shooter 310, target 410, and manager 510 can each include hardware (320, 420, 520) and one or more computer program products (340, 440, 530). The computer program products (340, 440, 530) can be implemented as software, firmware, or fixed electronic logic. In one embodiment, various modules 342-350, 442-446, 532-538 of the computer program products can include configurable parameters and rules, which permit behavior of the modules 342-350, 442-446, 532-538 to be modified to suit user/administrator preferences.

The hardware (320, 420, 520) can include a processor (322, 422, 522), and a memory (324, 424, 523, 524) linked via a bus (336, 436, 528). Each computer program product (340, 440, 540) can be stored in a physical storage medium (e.g., memory 324, 424, 523, and/or 524) and can include program instructions executable by the processor (322, 422, 522). Configurations varying from specifics expressed in FIGS. 3-5, but consistent with the claims and/or details presented in FIGS. 1-2, are to be considered in scope of this disclosure.

Hardware 320 and 420 can include a position determination component 334, 434. The position determination component 334, 434 has previously been referred to as a GPS component for clarity of expression. References to GPS, as used in this disclosure, are to be expansively interpreted to include any position determination component 343, 434 as defined herein. That is, each position determination component 334, 434 can be a component used to determine a geographic position of the shooter 320 or target 410 within a physical combat simulation environment. The determined position can be an absolute position or a relative one, depending on implementation choices. In one embodiment, component 334, 434 can function based on GPS technologies, which receive signals from a constellation of satellites in geosynchronous orbit and/or supplemental ground relay stations, and which perform triangulations based on these signals. A GPS technology embodiment can be advantageous for time synchronizing system 180 components, as GPS signals inherently include a synchronized timing signal generated by atomic clocks. Embodiments exist and are contemplated, where component 334 and/or 434 utilize non-GPS technologies for position determinations. For example, Long Range Radio Navigation (Loran) technologies, WIFI location tracking technologies, cellular tracking technologies, global navigation satellite system (GNSS) technologies, Instrument Landing System (ILS) technologies, Microwave Landing System (MLS) technologies, VHF omnidirectional range technologies, TACtical Air Navigation (TACAN) technologies, and the like can be utilized in various contemplated embodiments if the disclosure.

Hardware 320, 420 can include an RF transceiver 320, 428, which can transmit and receive RF signals, such as those in which data 114-118 is encoded. The RF transceiver 320 can conform to any of a variety of known protocols, such as conforming to BLUETOOTH, ZIGBEE, WIRELESS USB, WIFI, or other such standards. The network transceiver 526 can include an RF transceiver, a line-based network transceiver, a microwave transceiver, and the like.

Optical transmitter 326 can be a component able to transmit focused energy (e.g., capable of producing optical signal of embodiment 250 or 257) at a wavelength, which the optical sensor 426 can receive. As used herein, optical transmissions include the near infrared spectrum as well as the visible light spectrum, as described. In one embodiment, the wavelength can be MILES compliant, which is currently approximately 904 nm. Other wavelengths can be advantageously used. For example, longer wavelengths can be used in environments that may obstruct shorter wavelength transmissions (e.g., longer wavelengths can better operate in smoky rooms common when pyrotechnics are used for weapon effect simulation or when in-room fires are being simulated). Actual hardware used for the optical transmitter 326 and sensor 426 can vary from implementation to implementation so long as a focused beam (spatially constrained) of transmitted energy at a designated wavelength range can be generated and received. In one embodiment (e.g., embodiment 250), transmitter 326 can be a scanning laser.

The transmitter 326 can be moved independently of the weapon barrel 330 in one embodiment. Thus, an aim point of the optical transmitter 326 can be different and moved semi-independent of the aim point of the barrel 330. The weapon simulation attachment 332 can include any necessary hardware (including an optical transmitter 326 aim point adjustment mechanism) needed to simulate a firing of kinetic ordinance. The attachment 332 can include internal equipment, such as a weapon fire trigger, a weapons heads up display, etc., which an operator can utilize to manipulate the simulated weapon. For example, attachment 332 can include controls for permitting an operator to rotate a turret, for adjusting an azimuth of a weapon barrel 330, etc.

Computer program products 340 of the shooter 310 can include an ordinance module 342, a shooter movement module 344, a target movement module 346, a fire control module 348, a target tracking module 350, and the like.

The ordinance module 342 can include rules and datasets for characterizing behavior of a variety of specific ordinances able to be fired by the shooter 310. Different ordinances can have different speeds, wind resistance effects, detonation effects, strike properties, dispersion effects, and the like. Some ordinances can also be self propelled (e.g., rockets) which can have a substantial effect on trajectory. Ordinance able to be simulated by module 342 can include explosive ordinances, chemical discharge ordinances, nuclear ordinances, and gas ordinances. Some ordinances are designed to break-up (e.g., scatter, produce shrapnel, etc.) or disperse during flight. Any ordinance capable of being characterized by digitally encoded data is able to be handled by ordinance module 342 and simulated in system 180.

The shooter movement module 344 is able to perform adjustments on the ordinance flight based on shooter movement. This movement includes turret movement (e.g., rotational movements), weapon barrel 330 angle adjustments, and vectored movements of a shooter itself. Because shooter 310 movements are able to be tracked and adjusted for specific times, the movement module 344 can adjust for movement both forward and backwards in time from a defined event. For example, movement forward in time from a fire event can be accounted for by module 344. Further, movement backwards in time (from a target interrogation event or target detection event, for example) can be modified backwards in time to determine a position of a shooter at a previously occurring firing event.

The target movement module 346 is able to perform adjustments based on target position and target movement. This information can be obtained from interrogating the target itself, which provides target specific feedback data 116. The availability of target position for shooter calculations negates a need for the shooter 310 to utilize an optical range finder. Because target 410 movements are able to be tracked and adjusted for specific times, the movement module 346 (like module 344) can adjust for movement both forwards and backwards in time from a defined event. Hence, a shooter 310 can adjust for shooter movement (via module 344), for ordinance movement (via module 342), and for target movement (via module 346) along a range of time from any definable event. This presumes that a target 410 and shooter 310 can be time synchronized with each other and that movement data is tracked by a synchronized timing signal (each associated with a time).

The fire control module 348 can generate a firing event in response to a trigger pull. The trigger pull can be manually triggered by a human operating the weapon and/or can be remotely triggered (via a command entered into a user interface of the simulation manager 510, for example). The fire control module 348 can impose fire delays and/or can generate weapon simulation effects (WSE) consistent with a real-world fire event.

The target tracking module 350 can be a module that tracks position and movement of a set of targets 410 in proximity to the shooter 310. Multiple targets 410 can be concurrently tracked. In one embodiment (e.g., timeline 205) the tracking of targets 410 and performance of related calculations can occur before a firing event. This permits a rapid response, which permits immediate barrel 330 movement post-firing. The target tracking module 350 can be continuously updated based upon feedback data 116 provided by the targets 410 themselves.

Additional modules can be placed in product 340 to account for specific simulations factors, which have not been otherwise described herein. For example, in one embodiment, a terrain module (not shown) can exist that provides a three dimensional map of a geographic region, which permits adjustments (flight path, vehicle movement, etc.) to be made based on terrain specific features to more accurately reflect environmental constraints. For example, a geographic feature can interfere with an ordinance travel path, which would cause a simulated ordinance to deviate (e.g., be deflected, to explode early, etc.) from a default travel path. In another example, a wind pattern module (not shown) can simulate wind conditions, which can affect an ordinance flight path and/or flight distance.

Computer program products 440 of the target 410 can include a GPS module 442, an interrogation response module 444, a fire reactive module 446, and the like.

The GPS module 442 can be a module that determines position, movement, and maintains in-memory records of the same for the target 410. Module 442 can optionally include in-vehicle navigation programs, which determines what is rendered on an in-vehicle navigation display.

The interrogation response module 444 is a module designed to detect an interrogation event and produce a suitable response. The response can provide an interrogation entity with position, vector, and other data of the target 410.

The fire reactive module 446 controls behavior of target 410 components responsive to a receipt of fire result data 118. Module 446 can interpret data 118 to determine whether the target 410 is affected by a simulated kinetic discharge of the shooter 310. When the target 410 is affected, target systems can be disabled (e.g., placed in a killed state) and/or can be degraded (e.g., placed in a wounded state) in accordance with an effect of being struck by or within a blast radius of the simulated ordinance fired by the shooter 310.

Computer program products 530 of the simulation manager can include an operating system 532, a simulation manager 534, a target tracking module 536, a movement adjustment module 538, and the like.

The operating system 532 can be a desktop operating system 532 (e.g., LINUX, SUNOS, WINDOWS, etc.), a server operating system or a mainframe operating system (Z/os, General Comprehensive Operating System (GCOS), etc.). In one embodiment, the operating system can be a virtualized operating system that operates at a layer of abstraction above the hardware of the underlying device 510 and that may operate at a layer of abstraction over an operating system executing upon a device 510. A JAVA 2 Enterprise Edition (J2EE) application server is one example of a virtualized operating system. Others include VMWARE ESX, VMWARE WORKSTATION, Xen, and the like. In another embodiment, the computing device 510 can be a special purpose device in which one or one of the computer program products 532-538 execute directly above the hardware 520 without the existence of an intervening OS layer being imposed in between.

Simulation manager 534 can create a virtualized environment showing shooters, targets, and statuses of each. Simulation manager 534 can be used to analyze activities occurring in a simulation in real-time, near-real time, or after an appreciable delay—depending on implementation choices utilized. In one embodiment, the simulation manager 534 can include a communication application for selectively communicating (via voice, text, etc.) with any simulation participants (e.g., humans operating/located in a shooter or target). The simulation manager 534 can also be used to trigger simulation events, such as to revive a "killed" simulation participant, to "kill" a simulation participant who is otherwise alive, to enable/disable targets and/or automated firing solutions, to actuate weapons simulation effects (WSE) during a simulation, and the like.

The target tracking module 536 and/or movement adjustment module 538 are functionally equivalent to the corresponding modules 346 and 350. Modules 536, 538 are shown in manager 510 to expressly indicate that any of the products 340 or 440 are able to be hosted within manager 510. In other words, processing expressed in the disclosure as occurring within shooter 310 or target 410 can be alternatively performed within manager 510 (or other communicatively linked computing device) without a substantial difference in overall effect.

Figure 6:
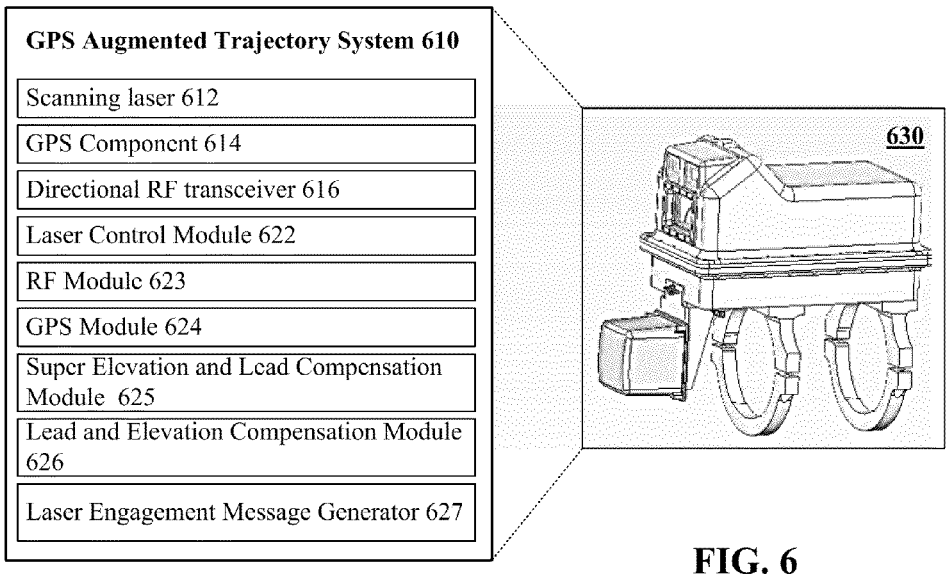
FIG. 6 shows a schematic diagram of a GPS augmented trajectory tracking (GATS) system in accordance with an embodiment of the disclosure.

FIG. 6 shows a schematic diagram 600 of a GPS augmented trajectory tracking (GATS) system 610 in accordance with an embodiment of the disclosure. System 610 represents a discrete system that is able to be mounted to a barrel of a shooter 310 to perform functions described for the shooter 310.

System 610 is a particular embodiment for implementing components of shooter 310. The vertical scanning laser 612 can be an instance of transmitter 326. The GPS component 614 can be an instance of component 334. The high gain directional RF transceiver 616 can be an instance of RF transceiver 328. Modules 622-627 can be specific modules of computer program products 340 for the embodiment represented by system 610.

The GATS system 610 uses components 612-616 to eliminate the need for laser rangefinders and retro reflectors. It also allows the system 610 to track multiple targets and allows the system 610 to be able to move away from the target very quickly after a firing. Image 630 is one contemplated configuration for the system 610.

Vertical scanning laser 612 can produce a scanned laser to allow for previous super-elevation of a barrel. Laser 612 can allow targets to be selected prior to trigger pull. The scanning laser 612 can always be searching for new potential targets. Any target that receives a scan from laser 612 can be aware that it has been interrogated. Laser 612 solves problems related to knowing which shooter is aiming at which target and when the aiming occurs. Module 622 can control movement of laser 612 and can perform related processing operations.

In one embodiment, the laser 612 can continuously scan to make a vertical fan bean that is wide enough to cover a maximum amount of effective drop for a previously selected round. For example, an approximate value for a HEAT round can correspond to a vertical scan of ten degrees dropping from the barrel centerline. For an AP round, the drop can be significantly less than a HEAT round, so a corresponding vertical scan of one and one-half degrees can be appropriate.

The high gain directional RF transceiver 616 can be designed for sending and receiving along a small corridor in the axis of a weapon barrel. This solves problems with communicating over a four thousand meter range, which when using omni-directional RF transceivers can potentially disrupt other communications in a physical combat simulation environment (e.g., the training field). The directional RF transceiver 616 can establish a focused link with a target. Once the RF link is established, details of position and velocity can be transferred from the target to the shooter. This information can be held for a trigger pull event. Secondary targets can also link whenever a scan (from laser 612) reaches them. Details for each target (multiple ones being possible) can be separately stored (in a memory 324 of system 610, not expressly shown) and processed (by a processor 322 of system 610, not expressly shown). As a scan from laser 612 leaves a potential target, the target can be dropped from processing, as it no longer needs to be tracked. Module 623 can comprise programmatic instructions and logic for transceiver 616.

Prior to trigger pull, the system 610 is able to have already determined the most appropriate target for the pull. Super elevation and lead compensation module 625 can calculate the perpendicular velocity minus the shooter perpendicular velocity along with range to target and altitude variance. Previously knowing the projectile type and the weapon firing characteristics, from feedback (116) obtained from the target, the firing solution can be determined.

When the trigger is pulled system 610 can utilize lead and elevation compensation module 626 to calculate the amount of lead and super-elevation that would be required to affect a hit. Module 626 can perform functions of a mini-fire control system. The laser beam (of laser 612) used for simulating the projectile is moved to the exact opposite of the lead and super-elevation. In this way, if the barrel (of laser 612) was moved correctly, the laser beam is now pointing exactly at the intended target.

Once pointed in position, the system 610 simply sends the laser encoded message (118) and adds any dither required to support errors associated with laser beam size and potential calculation error. These types of calculations and message encodings can be handled logic of the laser engagement message generator 627.

In one embodiment, the position adjustment modules 622-627 can use relative positions. Thus, a relative aim point of a barrel can be assured rather than trying to determine actual (absolute) barrel direction. The relative altitude difference can also be determined, which can produce fewer errors with fewer calculations than using absolute numbers. Relative velocity vectors can also make projectile calculations tolerable and faster than using absolute velocities.

It should be appreciated that in order to instrument vehicles in the field for system 610 to properly function, an instrumented target with GPS and MILES detection systems can simply add a small RF link triggered by a detection of a MILES message associated with the vertical scan of laser 612. If the target was not previously instrumented for MILES, the target must simply add a small MILES detection module with an integrated GPS and RF link. This device would simply track the target position and calculate a velocity vector which is transmitted any time that the vertical scanning laser message is received. This device is much less delicate than retro-reflectors and it can be totally integrated with training instrumentation or completely applied separately for maximum flexibility.

Figure 7:
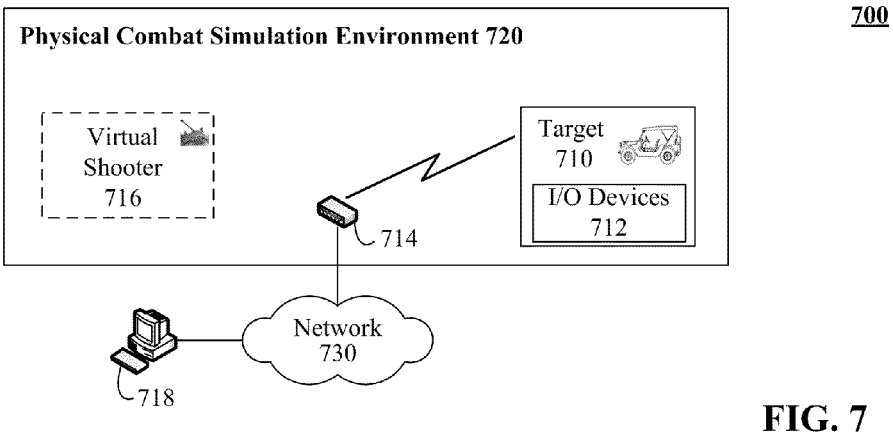
FIG. 7 is a schematic diagram showing a virtual shooter in accordance with an embodiment of the disclosure.

FIG. 7 is a schematic diagram 700 showing a virtual shooter 716 in accordance with an embodiment of the disclosure. Target 710 can be an instance of target 410 and computing device 718 can be an instance of simulation manager 510. The virtual shooter 716 can perform processing described for shooter 310 even though it is not physical present in environment 720.

To elaborate, a virtual shooter 716 is one that does not actually exist on a physical combat simulation environment 720, yet which the target 710 can react to. That is, a position and characteristics of the virtual shooter 716 can be defined by a computing device 718. In various embodiments, a virtual shooter 716 can simulate a plane dropping bombs, a tank shooting shells, a ship firing rockets, and any other shooter.

Virtual shooters 716 are possible due to disclosure specifics. That is, targets (such as target 710) are able to respond to interrogation messages 114 by providing feedback 116, which can result in fire response data 118 being conveyed back to the target 710. Further, it has also been noted that interrogation message 114 can be sent via a laser (embodiment 250) or via RF (embodiment 252). Fire response data 118 can be sent optically (embodiment 257) or via RF (embodiment 259). Thus, in one contemplated embodiment, an RF transceiver 714 within range of target 710 can exchange data 114-118 between target 710 and a network 730 connected computing device 718.

The target 710 can react to the transceiver 714 conveyed messages 714 in the exact same manner that it would react to a physical shooter present in environment 720. In one embodiment, input/output (I/O) devices 712 of the target 710 can also be modified to react to data conveyed via transceiver 714. For example, a radar monitor (an output device 712) of target 710 can show phantom signals for a virtual shooter 716, when told to do so by computing device 718.

Any of a variety of I/O devices 712 can be equipped to simulate virtual shooter 716 behavior. For example, internal speakers of target 710 can generate sound for a virtual shooter 716 to make the experience approximate an existence of a real shooter 716. Often humans inside a target 710 (such as a tank) can have limited external viewports, which makes internal instrumentation extremely important. This instrumentation can, however, be designed to produce simulated signals, which are effectively identical to real ones (at least to the occupants of the target 710). Optional vibration generators (I/O device 712) and other sensation creating devices can add robustness to virtual shooter 716 simulations. Use of virtual shooters 716 can be extremely cost effective (e.g., adding simulated planes, ships, etc.) compared to placing real-world shooters in the physical combat simulation environment 720.

As shown, the transceiver 714 can be an RF transceiver, such as a WIFI or WIMAX transceiver. The signals and data (e.g., messages 114-118) can include simulated coordinates for the virtual shooter 716, which the target 710 can utilize for its computations and responses.

Figure 8:
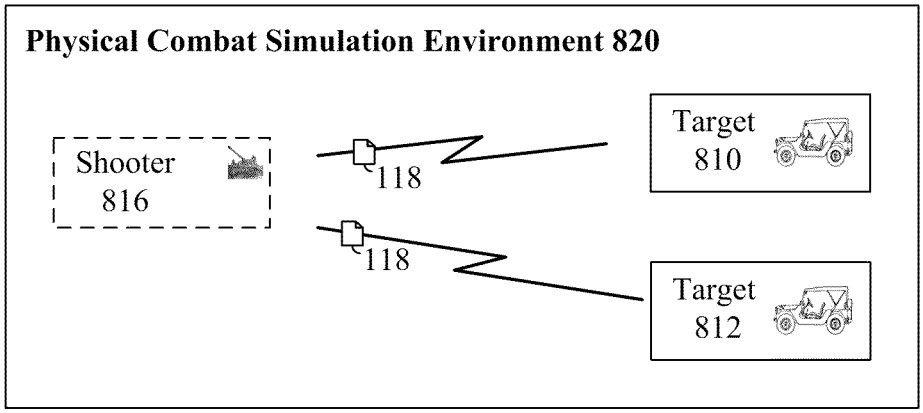
FIG. 8 is schematic diagram showing fire result data sent before a detonation time where targets determine their position relative to a blast radius at detonation time in accordance with an embodiment of the inventive arrangements disclosed herein.
Figure 8:
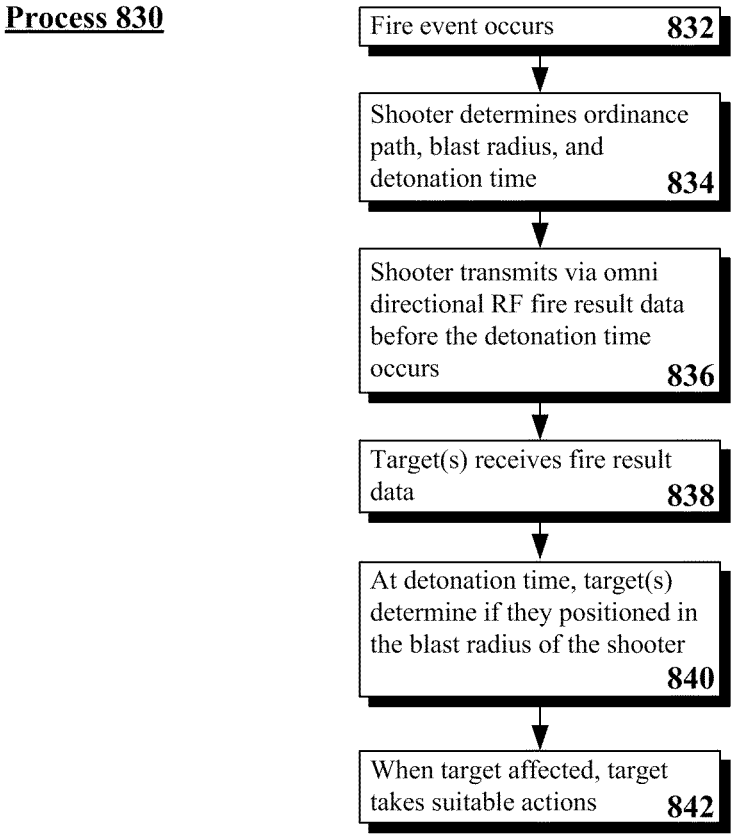

FIG. 8 is schematic diagram showing fire result data 118 sent before a detonation time where targets determine their position relative to a blast radius at detonation time in accordance with an embodiment of the inventive arrangements disclosed herein. FIG. 8 represents an alternative embodiment to FIG. 1, where instead of using feedback 116 from the target and/or pre-trigger pull processing to ensure the shooter's barrel can move rapidly after a fire event, FIG. 8 uses target-side processing. That is, since a target 812 actually determines whether it is in a detonation zone at detonation time, the shooter 816 is free to adjust its barrel aim point since no line-of-sight maintenance is required to determine a hit (e.g., no processing delay where line if sight is maintained).

In FIG. 8, the shooter 816 can be an instance of shooter 310. The target 810, 812 can be an instance of target 410. The shooter 816 and targets 810, 812 are physical entities concurrently present in the physical combat simulation environment 820. Fire result data 118 can include digitally encrypted data for a blast radius and detonation time along with other data, such as ordinance type, effect, and the like.

Process 830 shows a method for implementing target-side processing of fire result data 118. Process 830 can begin once a fire event occurs, as shown by step 832. Embodiments are contemplated where some pre-processing calculations (before a fire event) occur (see timeline 210, for example). In step 834, the shooter 816 can determine an ordinance path, blast radius, detonation time, and the like. The blast radius can define one or more geographic zones or regions affected by the fire event at the detonation time. In step 836, the shooter 816 can transmit (via an omni-directional RF transmission, for example) fire result data 118 before detonation time occurs. In step 838, the target(s) 810, 812 within range of the RF transmission can receive the fire result data 118 digitally encoded within the RF transmission. At detonation time, the target(s) 810, 812 can determine if they are positioned within the blast radius of the fire event (of step 832) at detonation time, as shown by step 840. In step 842, when a target 810,812 is affected the target 810, 812 can take suitable actions. Actions can include, for example, degrading systems of the target 810, 812 and/or disabling the target 810, 812 to represent that the target's condition has been degraded or completely disabled.

The diagrams in FIGS. 1-8 illustrate the architecture, functionality, and operation of possible implementations of systems, methods, and computer program products according to various embodiments of the disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the disclosure has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method comprising:

interrogating a physical target using a radio frequency interrogation signal in a physical combat simulation environment in which a simulation is being conducted;

receiving feedback from said target encoded within a radio frequency signal, said feedback comprising position data and movement data of the target;

calculating adjustments, via a processor executing a computer program product that implements a simulation manager for a simulated kinetic object traveling from a defined location of the physical combat simulation environment to said target, wherein said adjustments account for target movement and simulated kinetic object travel time and travel path from the defined location to the target, wherein a distance from the defined location to the target and movement of the target relative to the defined location is determined during said calculating utilizing the feedback;

the simulation manager determining a geographic position within the physical combat simulation environment of a virtual shooter, wherein said virtual shooter is not a physical entity present in the physical combat simulation environment but is a virtual artifact created and controlled by the simulation manager that emulates a physical shooter positioned for simulation purposes at a geographic position; and conveying a result signal comprising result data to the target, wherein the result data provides details for a kinetic object event relating to the simulated kinetic object traveling from the geographic position;

wherein the simulated kinetic object is a simulated ordinance fired from a simulated kinetic weapon of the virtual shooter, wherein the kinetic object event is a firing event of the simulated ordinance, wherein the result signal is a fire result signal, and wherein the result data is fire result data.

2. The method of claim 1, wherein interrogating the target comprises:

simulating the trajectory path of the simulated ordinance where the simulated ordinance is from a simulated scanning laser, which produces a plurality of laser emissions;

wherein said radio frequency interrogation signal comprises digitally encoded data and further comprising:

adjusting an aim point of the simulating scanning laser to a position of the target, where the position of the target is a calculated one that has been adjusted for movement of the target relative to the virtual shooter; and directing optical emissions of the simulated scanning laser to the aim point.

3. The method of claim 2, further comprising:

adjusting an aim point of the simulating scanning laser responsive to the calculated adjustments so that the aim point is targeting a position of the physical combat simulation environment in which the target is estimated to be located based upon the feedback provided by the target; and firing the laser at the aim point to convey the fire result signal, which is an optical signal, to the target.

4. The method of claim 1, further comprising:

the virtual shooter firing a simulated scanning laser to produce a plurality of laser emissions that emulate a trajectory path of the simulated ordinance, wherein the laser emissions are used for interrogating potential targets; and receiving feedback from said target responsive to the target sensing one of said laser emissions from the simulating scanning laser, wherein the feedback from the target comprises a vertical scan number for one of said laser emissions, said one laser emission being the one received by the target, which resulted in the target transmitting the radio frequency signal comprising the feedback.

5. The method of claim 1, wherein interrogating the target, receiving feedback from the target and performing at least a portion of the adjustment calculations occurs in advance of the kinetic object event.

6. A method comprising:

receiving interrogation data using a radio frequency interrogation signal from a virtual shooter in a physical combat simulation environment;

responsive to the interrogation data, determining, via a processor executing a computer program product that implements a simulation manager, position data of a target obtained from position determination component of the target, wherein said position data comprises a target position and a target movement vector;

the simulation manager determining a geographic position within the physical combat simulation environment of the virtual shooter, wherein said virtual shooter is not a physical entity present in the physical combat simulation environment but is a virtual artifact created and controlled by the simulation manager that emulates a physical shooter positioned for simulation purposes at a geographic position;

digitally encoding the position data in a radio frequency signal;

transmitting the radio frequency signal to the virtual shooter;

sensing fire result data from the virtual shooter;

computing, via the simulation manager an effect of a firing event in which said virtual shooter fired a simulated kinetic weapon at the target and calculations to compensate for movement of the virtual shooter relative to movement of the target and compensate for travel time and travel path of a simulated ordinance; and selectively adjusting a simulation state of target equipment based on the computed effect, wherein when said computed effect is that said target is hit by the simulated ordinance fired by the virtual shooter, wherein the simulated state of target equipment is adjusted from an active state to a disabled state or is adjusted downward to a degraded state of operation.

7. The method of claim 6, wherein the receiving of the interrogation data from the virtual shooter comprises:

sensing at least one laser emission from a simulated scanning laser of the virtual shooter;

determining a vertical scan number of the sensed laser emission and digitally encoding the vertical scan number in the radio frequency signal that is transmitted to the virtual shooter;

and further comprising:

calculating a blast time for the simulated ordinance.

8. A device comprising:

a simulation manager including processor and memory comprising a tangible storage medium executing a computer program product that implements a virtual shooter, wherein said virtual shooter is not a physical entity present in a physical combat simulation environment but is a virtual artifact created and controlled by the simulation manager that emulates a physical shooter positioned for simulation purposes at a geographic position;

the simulation manager implementing a position determination component capable of determining a geographic position of said device within the physical combat simulation environment;

the virtual shooter having a simulated kinetic projectile weapon comprising a weapon barrel;

an optical transmitter for emitting optical emissions;

a radio frequency transceiver for emitting radio frequency interrogation signals containing digitally encoded data and for receiving radio frequency signals containing digitally encoded data;

a bus for communicatively linking said processor, said memory, said optical transmitter, said radio frequency transceiver, and said position determination component to one another, said memory comprising at least one computer program product executable by said processor; wherein execution of the computer program product causes the device to:

calculate adjustments for a simulated ordinance fired from the simulated kinetic projectile weapon of the virtual shooter, wherein said adjustments account for target movement and simulated ordinance travel time and travel path from the simulated kinetic projectile weapon to a target, wherein said adjustments utilize data of the position determination component to adjust for movement of the device, wherein a distance to the target and position data and movement data of the target is determined using feedback provided by the target within the radio frequency signals detected by the radio frequency transceiver; and convey a fire result signal comprising fire result data for a firing event of the simulated ordinance to the target.

9. The device of claim 8, wherein said optical transmitter comprises a simulated scanning laser for repetitively transmitting a sequence of a plurality of different spatially constrained zones of optical emissions, each sequence covering a sequence angle of space relative to the optical transmitter producing the emission, said sequence angle being an angle of the simulated ordinance's trajectory, wherein execution of the computer program product causes the device to:

simulate the trajectory path of the simulated ordinance using the simulated scanning laser;

transmit said radio frequency interrogation signal from the radio frequency transceiver, which comprises digitally encoded data;

adjust an aim point of the optical transmitter to a position of the target, where the position of the target is a calculated one that has been adjusted for movement of the target relative to the device; and transmit a directional optical signal via the optical transmitter at the aim point, which conveys the fire result signal from the device to the target.

10. The device of claim 8, wherein execution of the computer program product causes the device to:

adjust an aim point of the optical transmitter responsive to the calculated adjustments so that the aim point is targeting a position of the physical combat simulation environment in which the target is estimated to be located based upon the feedback provided by the target; and transmit a directional optical signal via the optical transmitter at the aim point to convey the fire result signal, which is an optical signal, to the target, wherein the adjustments are calculated by the computer program product without utilizing data from an optical rangefinder and without utilizing optical feedback from the target.

11. The device of claim 8, wherein said device is a motorized vehicle able to transport at least one human about the physical combat simulation environment.

12. The device of claim 8, wherein execution of the computer program product causes the device to:

transmit a plurality of laser emissions using the optical transmitter, wherein said plurality of laser emissions emulate a trajectory path of the simulated ordinance, wherein the laser emissions are used for interrogating potential targets; and receive feedback from said target responsive to the target sensing one of said laser emissions from the optical transmitter, wherein the feedback from the target comprises a vertical scan number for one of said laser emissions, said one laser emission being the one received by the target, which resulted in the target transmitting the radio frequency signals comprising the feedback.

13. The device of claim 8, wherein at least a portion of the adjustment calculations occur in advance of the firing event.

14. A device comprising:

a simulation manager including processor and memory comprising a tangible storage medium executing a computer program product that implements a virtual shooter, wherein said virtual shooter is not a physical entity present in a physical combat simulation environment but is a virtual artifact created and controlled by the simulation manager that emulates a physical shooter positioned for simulation purposes at a geographic position;

the simulation manager implementing a position determination component capable of determining a geographic position of said device within the physical combat simulation environment;

an optical sensor for sensing Multiple Integrated Laser Engagement System (MILES) compliant optical emissions;

a radio frequency transceiver for emitting a radio frequency interrogation signal containing digitally encoded data and for receiving radio frequency signals containing digitally encoded data;

a bus for communicatively linking said processor, said memory, said optical sensor, said radio frequency transceiver, and said position determination component to one another, said memory comprising at least one computer program product executable by said processor, wherein execution of at least one computer program product causes the device to:

receive interrogation data from the virtual shooter in the physical combat simulation environment;

responsive to the interrogation data, determine position data obtained from the position determination component, wherein said position data comprises a device position of the device and a device movement vector;

digitally encode the position data in a radio frequency signal;

transmit the radio frequency signal via the radio frequency transceiver;

sense fire result data via the optical sensor;

compute an effect of a firing event in which the virtual shooter fired a simulated kinetic weapon at the device and calculations to compensate for movement of the virtual shooter relative to movement of the device and compensate for travel time and travel path of a simulated ordinance; and selectively adjusting a simulation state of the device equipment based on the computed effect of the firing event, wherein when said computed effect indicates that the device is hit by the simulated ordinance fired by the virtual shooter:

the simulated state of device equipment of the device is adjusted from an active state to a disabled state or is adjusted downward to a degraded state of operation.

15. A method for implementing a virtual shooter within a physical combat simulation environment comprising:

providing a simulation manager communicatively linked to a network, which is communicatively linked to a radio frequency transceiver in wireless communication range of potential targets deployed within the physical combat simulation environment, said simulation manager comprising a processor, and a storage medium, said storage medium comprising at least one computer program product stored in the storage medium and executable by the processor;

interrogating each of the potential targets in the physical combat simulation environment by having the radio frequency transceiver transmit interrogation data to the potential targets;

receiving feedback from at least one of said potential targets, wherein said feedback is digitally encoded within radio frequency signals detected by the radio frequency transceiver, said feedback comprising position data and movement data of the potential target from which feedback was received;

the simulation manager determining a geographic position within the physical combat simulation environment of said virtual shooter, wherein said virtual shooter is not a physical entity present in the physical combat simulation environment but is a virtual artifact created and controlled by the simulation manager that emulates a physical shooter positioned for simulation purposes at the geographic position;

calculating adjustments, via the processor executing the at least one computer program product, for a simulated ordinance from a simulated kinetic weapon of the virtual shooter to at least one of the potential targets, wherein said adjustments account for target movement and simulated ordinance travel time and travel path from the virtual shooter, wherein a distance from the virtual shooter to each of the potential targets and movement of each of the potential targets relative to the geographic position of the virtual shooter is determined during said calculating utilizing the feedback; and conveying a fire result signal generated by the simulation manager transmitted via the radio frequency transceiver to at least one of the potential targets, said fire result signal comprising fire result data for a firing event wherein the fire result data uniquely identifies at least one of the potential targets.

16. The method of claim 15, further comprising:

transmitting, via data encoded in radio frequency signals transmitted by the radio frequency transmitter, simulation data of the virtual shooter, wherein the simulation data is consumable by computing devices of each of the potential targets, wherein the simulation data when processed by each of the potential targets causes output devices of each of the potential targets to produce output for a human positioned proximate to each of the potential targets, wherein the produced output causes instruments of each of the potential targets to report an existence of the virtual shooter in the physical combat simulation environment.

17. The method of claim 16, wherein the simulation data causes speaker of at least one of the potential targets to emit sounds emulating sounds of the virtual shooter which a real shooter would produce within the physical combat simulation environment.

18. The method of claim 16, wherein the simulation data causes a display of at least one of the potential targets to produce images for the virtual shooter which a real shooter would produce upon the display if present within the physical combat simulation environment.

* * * * *